US005297734A

United States Patent [19]

Toda

[11] Patent Number: 5,297,734

[45] Date of Patent: Mar. 29, 1994

[54] ULTRASONIC VIBRATING DEVICE

[76] Inventor: Kohji Toda, 1-49-18, Futaba, Yokosuka, Japan

[21] Appl. No.: 774,098

[22] Filed: Oct. 11, 1991

[30] Foreign Application Priority Data

| | | | |
|---|---|---|---|
| Oct. 11, 1990 | [JP] | Japan | 2-273001 |
| Nov. 30, 1990 | [JP] | Japan | 2-339179 |
| Nov. 30, 1990 | [JP] | Japan | 2-339180 |
| Nov. 30, 1990 | [JP] | Japan | 2-339181 |

[51] Int. Cl.[5] ..... B05B 1/08

[52] U.S. Cl. ..... 239/102.2

[58] Field of Search ..... 239/102.2, 338, 102.1

[56] References Cited

U.S. PATENT DOCUMENTS

| | | | |
|---|---|---|---|
| 2,739,623 | 1/1957 | Eisenkraft | 239/102.2 X |
| 3,558,052 | 1/1971 | Dunn | 239/124 X |
| 4,659,014 | 4/1987 | Soth et al. | 239/102.2 |
| 4,753,579 | 6/1988 | Murphy | 239/102.2 X |

FOREIGN PATENT DOCUMENTS

| | | | |
|---|---|---|---|
| 4714 | 1/1985 | Japan | 239/102.2 |
| 2073616 | 10/1981 | United Kingdom | 239/102.2 |
| 973458 | 10/1984 | United Kingdom | 239/102.2 |

*Primary Examiner*—Andres Kashnikow
*Assistant Examiner*—Kevin P. Weldon
*Attorney, Agent, or Firm*—Cushman, Darby & Cushman

[57] ABSTRACT

An ultrasonic vibrating device for atomizing a liquid by acoustic vibrations generated using a vibrating plate mounted to a piezoelectric vibrator. The piezoelectric vibrator consists of a piezoelectric ceramic and a pair of electrodes positioned thereon and on both end surfaces perpendicular to the thickness direction of the piezoelectric ceramic. The vibrating plate is provided with a lot of holes, the area of each hole opening on a top surface being different from the area of its other opening. The piezoelectric vibrator being efficiently vibrated in response to an alternating current voltage, whose frequency is almost matched to the resonance frequency of the piezoelectric vibrator. This vibration is transmitted to the vibrating plate causing the vibrating plate to also vibrate. A liquid introduced to the vibrating plate is effectively atomized by way of the vibrating plate and the holes thereon.

43 Claims, 25 Drawing Sheets

| TYPE | I | II | III |
|---|---|---|---|
| SAMPLE SIZE (mm) |   |   |   |
| APPLIED VOLTAGE (V) | 10.6 | 7.0 | 6.7 |
| CURRENT (mA) | 50 | 20 | 60 |
| POWER (mW) | 530 | 140 | 402 |
| FREQUENCY (kHz) | 286.1 | 286.1 | 286.0 |

ULTRASONIC VIBRATING DEVICE

BACKGROUND OF THE INVENTION

1. Field of the Invention

The present invention relates to an ultrasonic vibrating device for atomizing a liquid by the acoustic vibration generated with an ultrasonic vibrator.

2. Description of the Prior Art

Conventional atomizing devices include a Langevin-type vibrator device having a bolt and a Nebulizer type device. A vibrating device having a Langevin-type vibrator which uses a bolt operates at a frequency of some 10 kHz and is capable of generating a large quantity of fog. However, the Langevin-type device structure is complicated and its size large. A Nebulizer atomizing device also operates by ultrasonic vibration and operates at a frequency in the MHz range. The Nebulizer is most useful for atomizing minute and uniform particles. However, a Nebulizer has the disadvantage of producing a minimal quantity of fog and uses large electric power since it provides low atomization efficiency. Thus, conventional devices have several deficiencies including low atomization efficiency, poor atomization ability, restrictions on atomized particle size, and high costs of operation resulting from high power supply requirements.

SUMMARY OF THE INVENTION

An object of the present invention is to provide a vibrating device having a high efficiency of atomization and low power supply requirements.

Another object of the present invention is to provide a vibrating device capable of providing a large quantity of fog.

Another object of the present invention is to provide a vibrating device configurable for a desired minuteness and uniformity of fog particle size.

Another object of the present invention is to provide a vibrating device with a small size which is very light in weight and has a simple structure.

A still further object of the present invention is to provide a vibrating device operating with low power consumption.

According to one aspect of the present invention there is provided a vibrating device comprising an ultrasonic vibrator which generates an acoustic vibration to atomize a liquid. The ultrasonic vibrator is composed of a piezoelectric vibrator and a vibrating plate.

According to another aspect of the present invention there is provided a means for supplying a vibrating plate with a liquid.

According to another aspect of the present invention there is provided a piezoelectric vibrator composed of a piezoelectric ceramic and a pair of electrodes on both end surfaces, perpendicular to the thickness direction, of the piezoelectric ceramic.

According to a further aspect of the present invention there is provided a vibrating plate having a lot of conical shaped holes such that the hole openings on one side of the vibrating plate are different in size from the hole openings on the other side of the vibrating plate.

BRIEF DESCRIPTION OF THE DRAWINGS

Other features and advantages of the invention will be evident from the following description with reference to the attached drawings.

DETAILED DESCRIPTION OF THE PRESENTLY PREFERRED EXEMPLARY EMBODIMENTS

Figure 1:
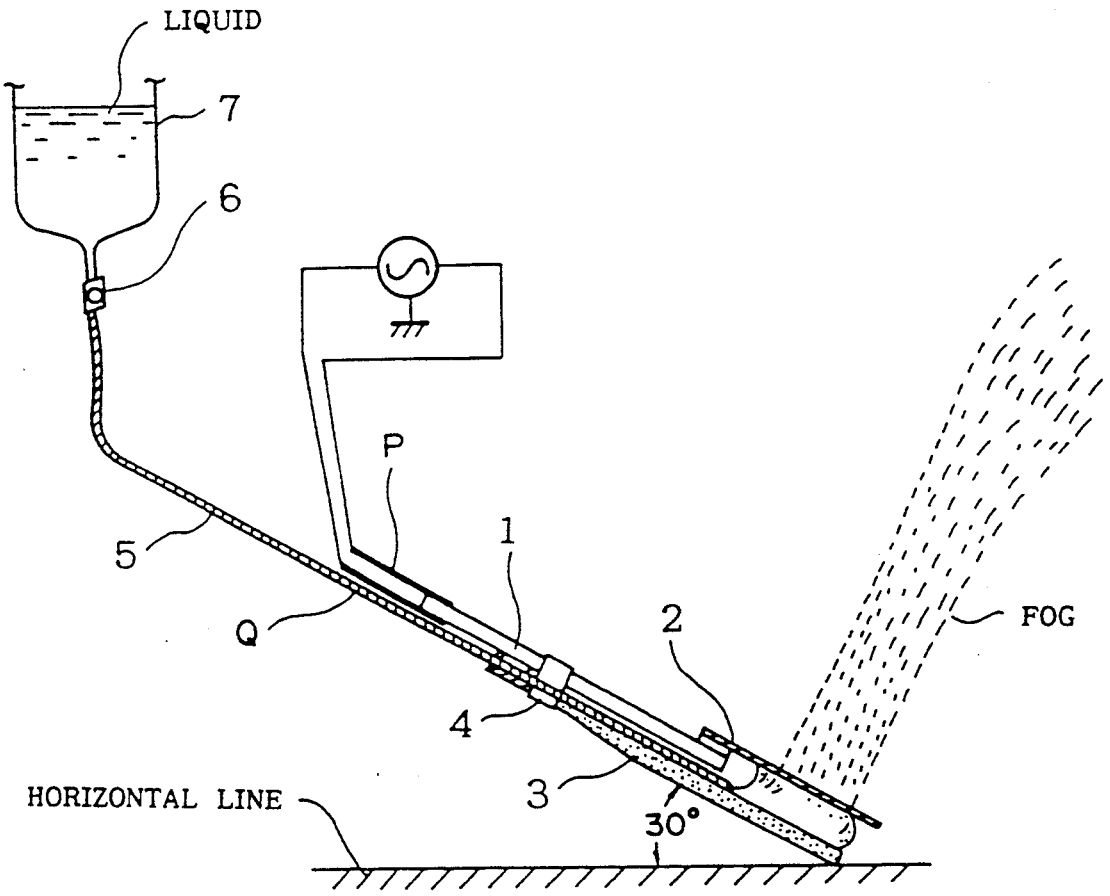
FIG. 1 shows a sectional view of the ultrasonic atomizing device according to a first embodiment of the present invention.

FIG. 1 shows a sectional view of an ultrasonic vibrating device according to a first embodiment of the present invention. The ultrasonic vibrating device comprises piezoelectric vibrator 1 to which a pair of electrode terminals, P and Q, made from copper ribbon are mounted, vibrating plate 2, assistance board 3, clip 4, liquid supplying tube 5, flow control valve 6 and liquid tank 7. Also shown is a power supply circuit which supplies piezoelectric vibrator 1 with an alternating current voltage. Liquid tank 7 is supplied with an adequate amount of liquid when in use. Electrode terminals, P and Q, are cemented to piezoelectric vibrator 1 by an adhesive agent which is of high conductivity.

Figure 2:
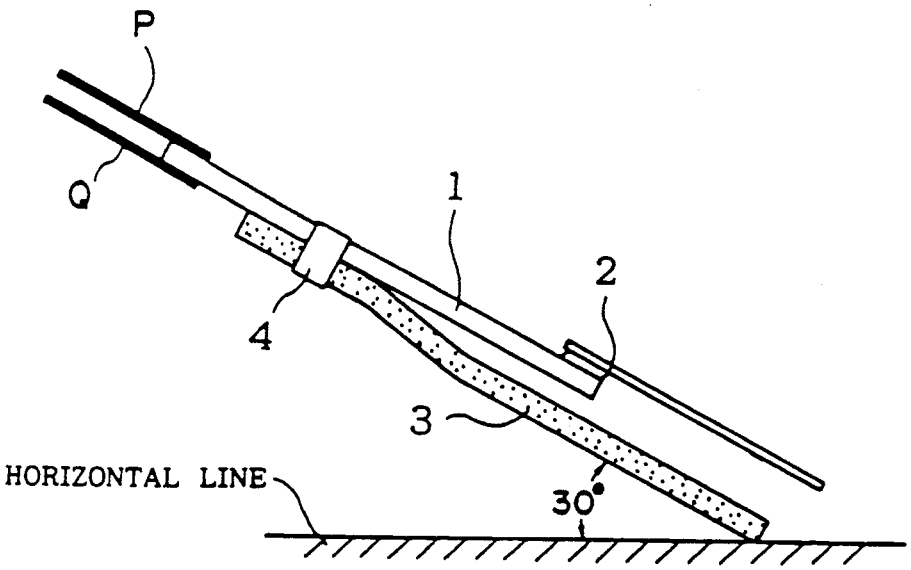
FIG. 2 shows a sectional view of the first embodiment shown in FIG. 1 absent liquid supplying tube 5, flow control valve 6 and liquid tank 7.

FIG. 2 shows a sectional view of the first embodiment shown in FIG. 1 absent liquid supplying tube 5, flow control valve 6 and liquid tank 7. The ultrasonic vibrator composed of piezoelectric vibrator 1 and vibrating plate 2 is jointed to assistance board 3 by clip 4. Assistance board 3 is useful for the efficient transmission of vibrations from piezoelectric vibrator 1 to vibrating plate 2. The ultrasonic vibrator is adapted to have an inclined slope of about 30 degrees from a horizontal reference surface. This arrangement increases the speed for providing the liquid supply to the minute space between vibrating plate 2 and assistance board 3 thereby increasing the efficiency of atomizing the liquid. Assistance board 3 is made from foamed styrene. The acoustic impedance of foamed styrene is very low when compared with the acoustic impedance of the piezoelectric vibrator material. Therefore the transmittance of vibrations of piezoelectric vibrator 1 to assistance board 3 is suppressed and vibrating plate 2 is vibrated more effectively, thereby increasing the atomization efficiency of the device.

Figure 3:
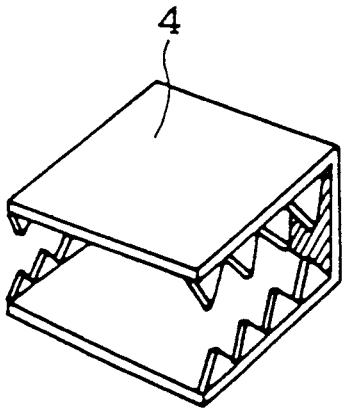
FIG. 3 shows a perspective view of clip 4 shown in FIG. 1.
Figure 4:
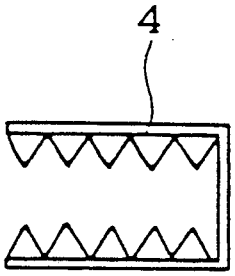
FIG. 4 shows a side view of clip 4 shown in FIG. 3.

FIG. 3 shows a perspective view of clip 4 shown in FIG. 1. FIG. 4 shows a side view of clip 4 shown in FIG. 3. Clip 4 is made of stainless steel, and joins the piezoelectric vibrator 1 and the vibrating plate 2 together by virtue of the spring inherent in its structure, so as to adequately transmit vibrations of piezoelectric vibrator 1 to vibrating plate 2 to efficiently atomize the liquid.

The amount of liquid drawn and guided by flow control valve 6 from liquid tank 7 through liquid supplying tube 5 and then supplied into the minute space between vibrating plate 2 and assistance board 3 is controlled to maximize atomization efficiency. Thus, since the means for supplying liquid comprises liquid tank 7 and tube 5 for drawing and guiding the liquid from liquid tank 7 and then supplying vibrating plate 2 with the liquid, the liquid is effectively supplied on vibrating plate without waste. Accordingly, atomization efficiency is enhanced.

Figure 5:
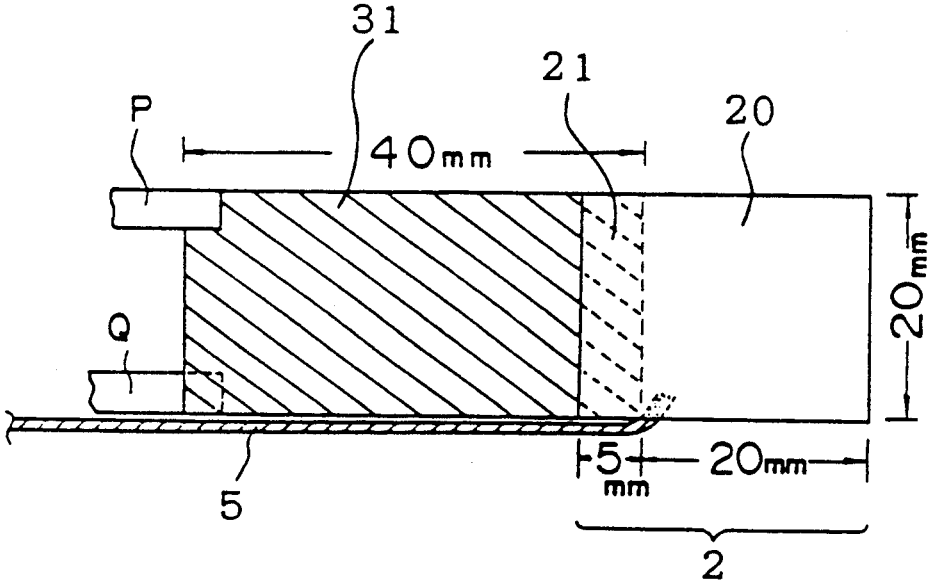
FIG. 5 shows a plan view of the ultrasonic vibrator (that is the device composed of piezoelectric vibrator 1 and vibrating plate 2) shown in FIG. 1.
Figure 6:
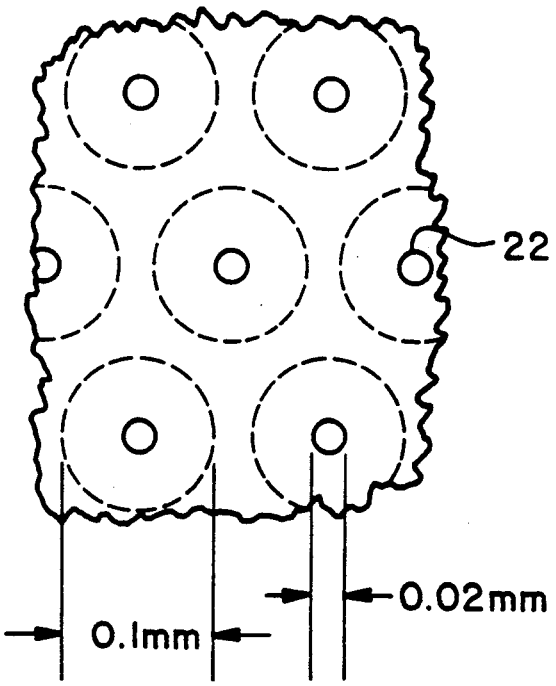
FIG. 6 shows a fragmentary top plan view, on an enlarged scale, of a portion of the vibrating part 20 shown in FIG. 5.

FIG. 5 shows a plan view of the ultrasonic vibrator (that is the device composed of piezoelectric vibrator 1 and vibrating plate 2) shown in FIG. 1. FIG. 6 shows a fragmentary top plan view, on an enlarged scale, of a portion of the vibrating part 20 shown in FIG. 5. In FIG. 6 the shape arrangement and size of holes 22 are shown.

Figure 7:
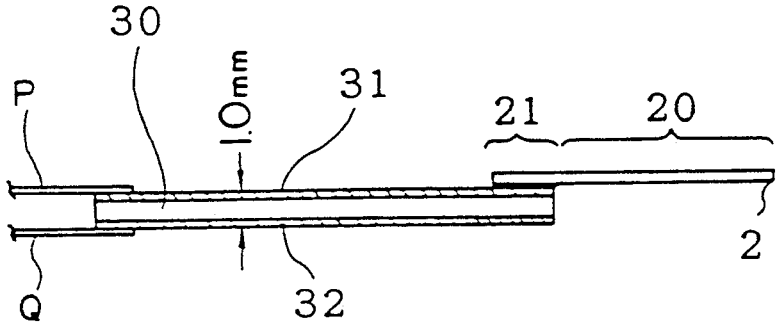
FIG. 7 shows a side view of the ultrasonic vibrator shown in FIG. 5.

FIG. 7 shows a side view of the ultrasonic vibrator shown in FIG. 5. The ultrasonic vibrating device can be made small and compact by incorporating a simple construction for the piezoelectric vibrator consisting of a piezoelectric ceramic and a pair of electrodes on the both end surfaces perpendicular to the polarization axis of the piezoelectric ceramic. In addition, it is possible to atomize a liquid with high efficiency and operate the ultrasonic vibrating device with very low power consumption.

Figure 8:
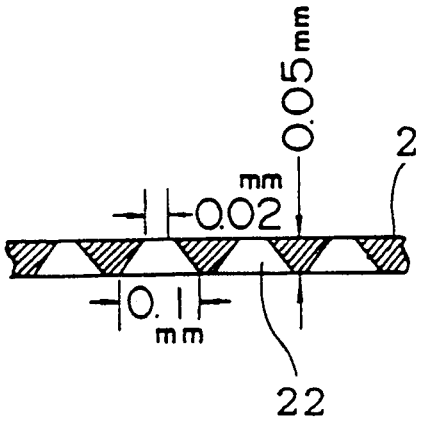
FIG. 8 shows a fragmentary vertical sectional view, on an enlarged scale, of a portion of vibrating part 20 shown in FIG. 5.

FIG. 8 shows a fragmentary vertical sectional view, on an enlarged scale, of a portion of vibrating part 20 shown in FIG. 5. In FIG. 8 the shape and size of the hole 22 are shown.

Piezoelectric vibrator 1 comprises rectangular plate-like piezoelectric ceramic 30, being made TDK-72A material (manufactured by TDK, Ltd. of Japan), and having dimensions of 40 mm in length, 20 mm in width and 1 mm in thickness. Because TDK-72A provides a large electromechanical coupling constant, this material is well suited for this invention. The direction of the polarization axis of piezoelectric ceramic 30 is along the direction of its thickness. Au electrode 31 and Au electrode 32 are formed on both end surfaces perpendicular to the thickness direction of piezoelectric ceramic 30. Au electrode 31 covers one end surface of piezoelectric ceramic 30 and Au electrode 32 covers the other end surface. Au electrode 31 is provided with an electrode terminal P, and the Au electrode 32 is provided with electrode terminal Q. Electrode terminals, P and Q, are mounted at one edge along the width direction of piezoelectric ceramic 30.

The tongue-like vibrating plate 2 is attached to one end surface of piezoelectric vibrator 1. Vibrating plate 2 is made of nickel and is cemented to be integrally interlocked with the piezoelectric vibrator 1 at a slender plate-like cemented part 21. Part 21 is cemented to piezoelectric vibrator 1 with an adhesive agent having high conductivity in contact with Au electrode 31. The dimensions of vibrating plate 2 are 25 mm in length, 20 mm in width and 0.05 mm in thickness.

Vibrating part 20 extends in parallel with the plate surface of piezoelectric vibrator 1 toward the outside of the edge along the width direction of piezoelectric vibrator 1 and is projected therefrom. The dimensions of vibrating part 20 are 20 mm in length, 20 mm in width and 0.05 mm in thickness. The vibrating part 20 is provided with a plurality of minute holes 22 which penetrate the thickness direction. The holes 22 which are of inverse-conical shape have an opening area on one side which is larger than the opening area on the other side in this first embodiment. One opening is used as an inlet side and the other is used as an outlet side. The inlet side diameter is 0.1 mm and the outlet side diameter is 0.02 mm. The holes 22 are disposed with an equal pitch.

If an alternating current signal having substantially the same frequency as the resonance frequency of the device, composed of piezoelectric vibrator 1 and vibrating plate 2, is applied to piezoelectric vibrator 1 through electrode terminals, P and Q, then when operating the ultrasonic vibrating device of FIG. 1, piezoelectric vibrator 1 is vibrated. At this time, the frequency of the alternating current signal is substantially equal to one of the resonance frequencies of piezoelectric vibrator 1. Because vibrating plate 2 is cemented and integrally interlocked with at least one end surface of piezoelectric vibrator 1, vibrating plate 2 can be made to vibrate just like a one side supported overhanging beam with cemented part 21 acting as a cementing end. A liquid which is supplied to vibrating part 20 under a strong acoustic vibrating condition can be atomized or sprayed upwards in the vertical direction. Furthermore, as atomizing quantity is increased by increasing the applied voltage, it is possible to control the atomizing quantity by varying the applied voltage.

In the ultrasonic vibrating device shown in FIG. 1, the liquid which is supplied into the minute space through liquid supplying tube 5 from liquid tank 7 during vibration of vibrating part 20 is led to respective holes 22 by capillarity. When the liquid passes through each of holes 22, the liquid passing area of liquid in each one of the holes 22 is reduced from the inlet side thereof to the outlet side thereof. The liquid is therefore squeezed out by respective holes 22, providing a liquid having minute and uniform particles which flow out on vibrating part 20. Consequently, the liquid which flows out from respective holes 22 can be atomized very effectively by virtue of this squeezing action, the acoustic vibration of vibrating part 20, an increased liquid feeding speed resulting from the angled ultrasonic vibrator, and the fact that flow control valve 6 can effectively control the amount of liquid flowing into the above described minute space.

Figure 9:
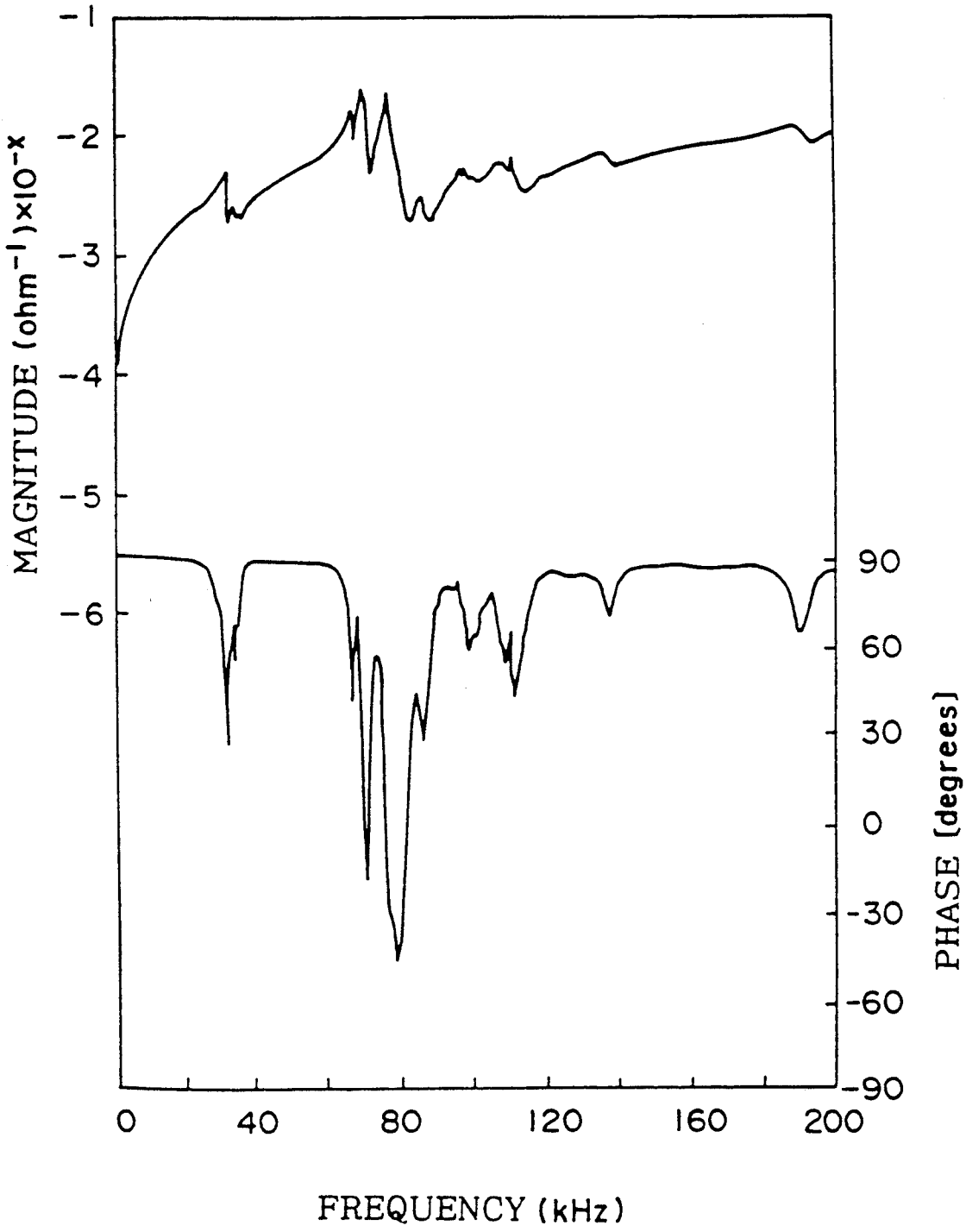
FIG. 9 shows the frequency dependencies of the magnitude and the phase of the admittance of piezoelectric vibrator 1.

FIG. 9 shows the frequency dependencies of the magnitude and phase of the admittance of piezoelectric vibrator 1. One such frequency which is very effective for operation of a vibrating device provides a resonance around 100.8 kHz.

Figure 10:
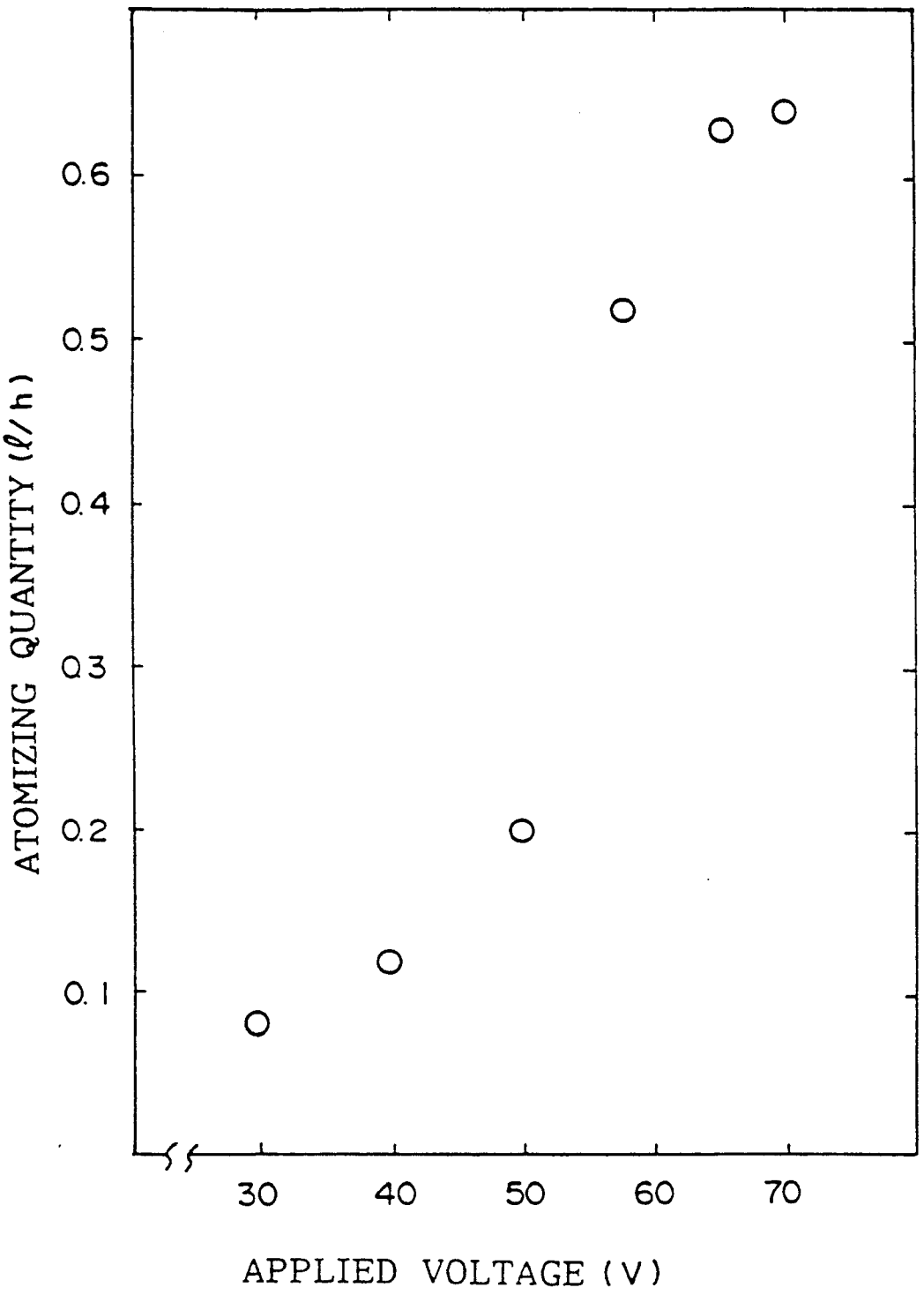
FIG. 10 shows the relationship between the atomizing quantity and the applied voltage for the first embodiment.

FIG. 10 shows the relationship between the atomizing quantity and the applied voltage for the first embodiment of the present invention. As the applied voltage becomes greater than 0 and approaches 30 Vp-p or greater, fog can be blown out from vibrating part 20. At a resonance frequency of 100.8 kHz, an applied voltage for producing maximum atomizing quantity is 76 Vp-p. With a voltage greater than 76 Vp-p, the atomizing quantity becomes saturated. As shown in FIG. 10, the atomizing quantity radically increase in response to an applied voltage up to and around 60 Vp-p.

Figure 11:
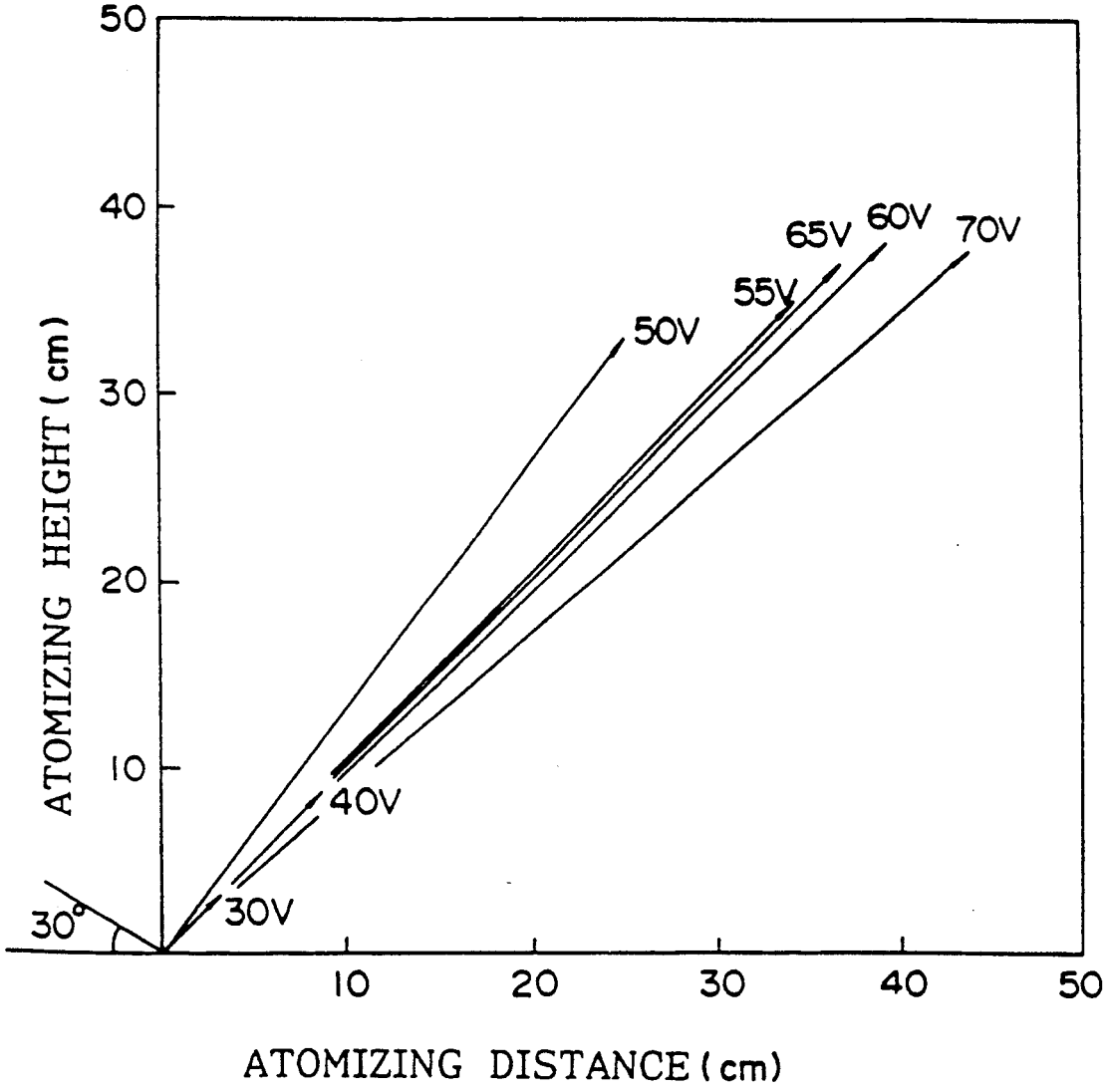
FIG. 11 shows the relationship between the atomizing height and the atomizing distance for various applied voltages for the first embodiment.

FIG. 11 shows a relationship between the atomizing height and the atomizing distance for various applied voltages for the first embodiment of the present invention. FIG. 11 shows changes similar to those in FIG. 10, the power of the fog is strengthened radically from around 40 Vp-p and is saturated at 60 Vp-p.

Figure 12:
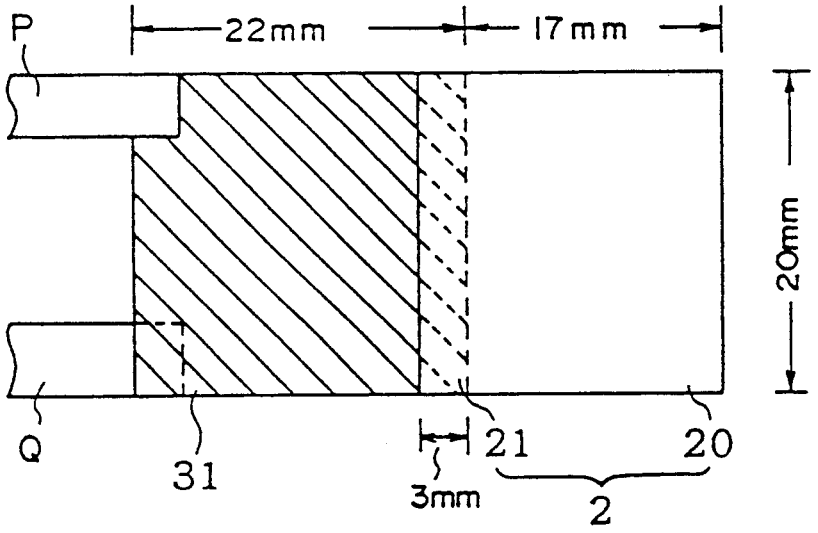
FIG. 12 shows a plan view of another embodiment of the ultrasonic vibrator.

FIG. 12 shows a plan view of another embodiment of the ultrasonic vibrator shown in FIG. 5. In FIG. 12 the ultrasonic vibrator has piezoelectric vibrator 1 which is 22 mm long, 20 mm wide and 1 mm thick and vibrating plate 2 which is 17 mm long, 20 mm wide and 0.05 mm thick. In an ultrasonic vibrator as shown in FIG. 12, the atomizing quantity becomes maximum with a frequency of 114.6 kHz and an applied voltage of 9.8 V. The power consumption is 294 mW and current loading is 30 mA. For a whole atomizing device which would include a power supply, the power consumption becomes 588 mW and the current loading 60 mA. Thus, a device having a rectangular plate-like structure where the ratio between the length and the width is nearly 1 but not exactly equal to 1, the coupled-mode vibration of the device composed of the piezoelectric vibrator and the vibrating plate is strengthened, and the atomizing quantity is further increased.

Figure 13:
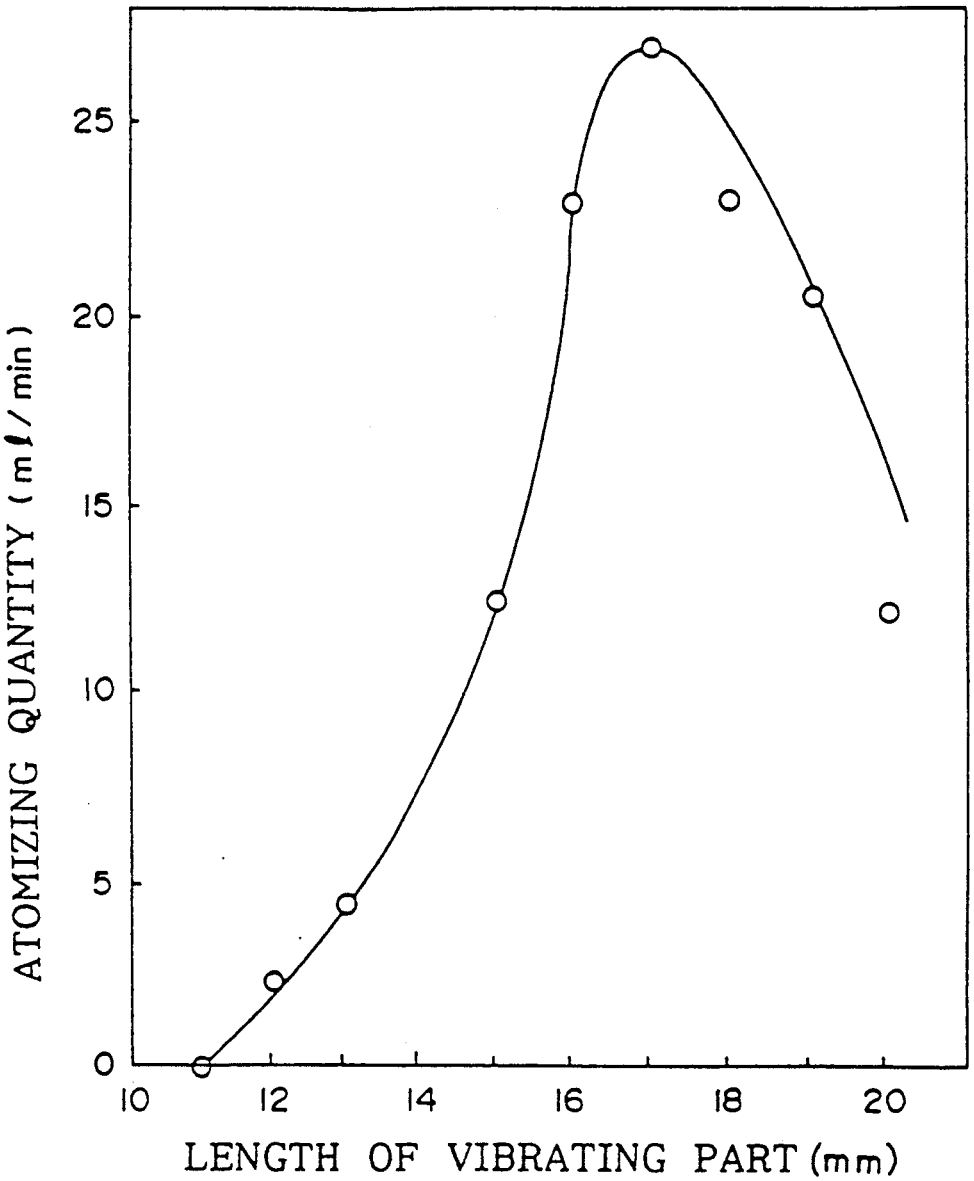
FIG. 13 shows the relationship between the length of vibrating part 20 and the atomizing quantity for the ultrasonic vibrator shown in FIG. 12.
Figure 14:
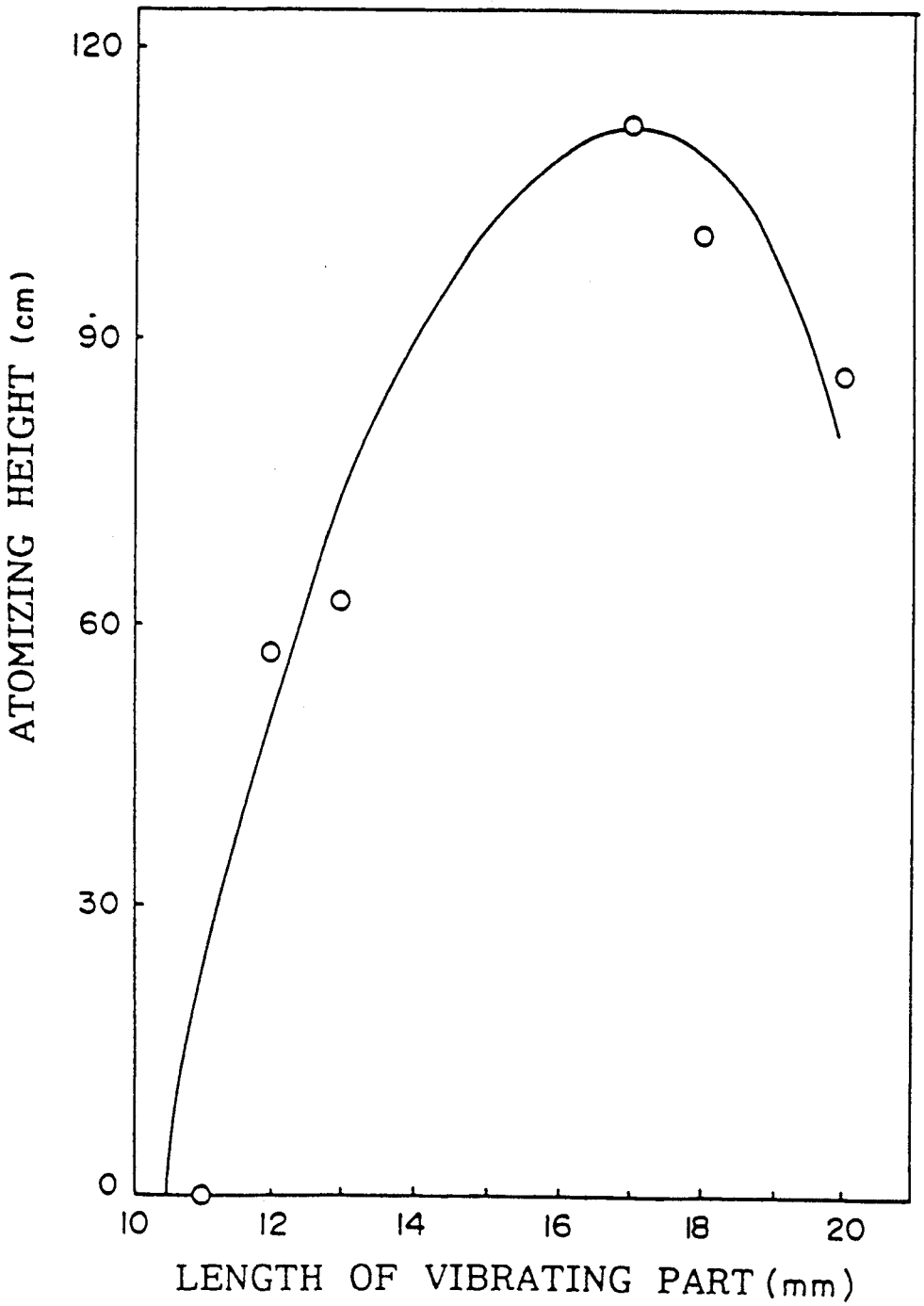
FIG. 14 shows the relationship between the length of vibrating part 20 shown in FIG. 12 and the atomizing height.

FIG. 13 shows the relationship between the length of vibrating part 20 and the atomizing quantity for the ultrasonic vibrator shown in FIG. 12. When the length of vibrating part 20 is 17 mm, the atomizing quantity yields a maximum value of 27.5 ml/min. FIG. 14 shows the relationship between the length of vibrating part 20 shown in FIG. 12 and the atomizing height. However, in FIG. 14, the atomizing height equals what the oblique spouting is converted to as a value in the vertical direction. When the length of vibrating part 20 is 17 mm, the atomizing height reaches a maximum value of 112 cm.

Figure 15:
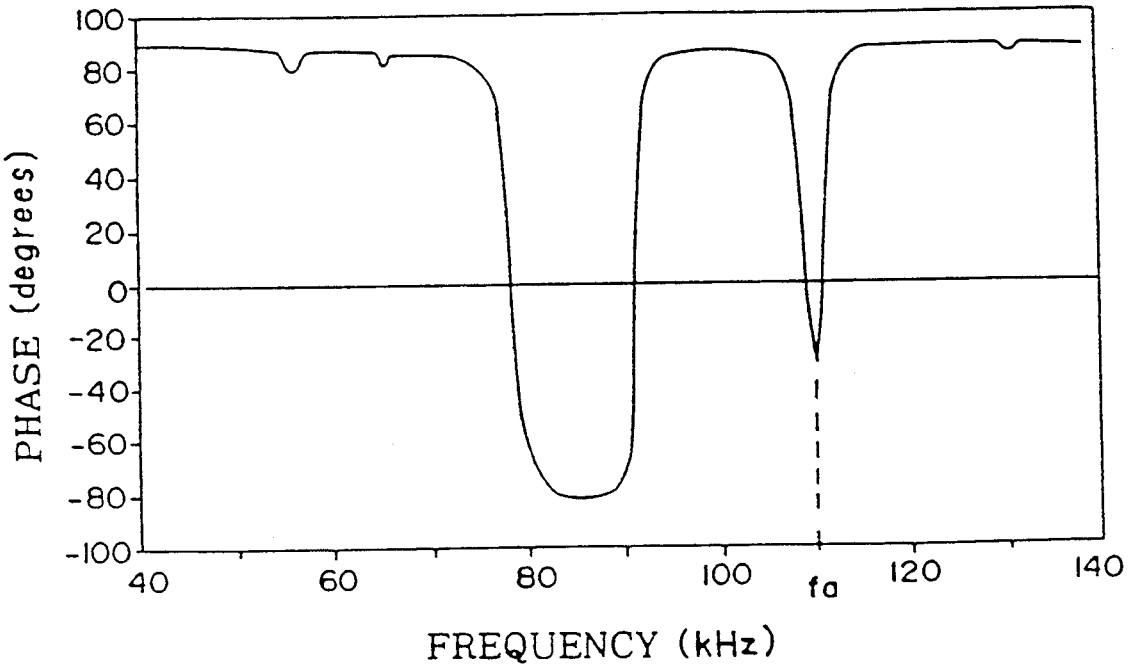
FIG. 15 shows the relationship between the phase of the impedance of piezoelectric vibrator 1 shown in FIG. 12 and frequency.
Figure 16:
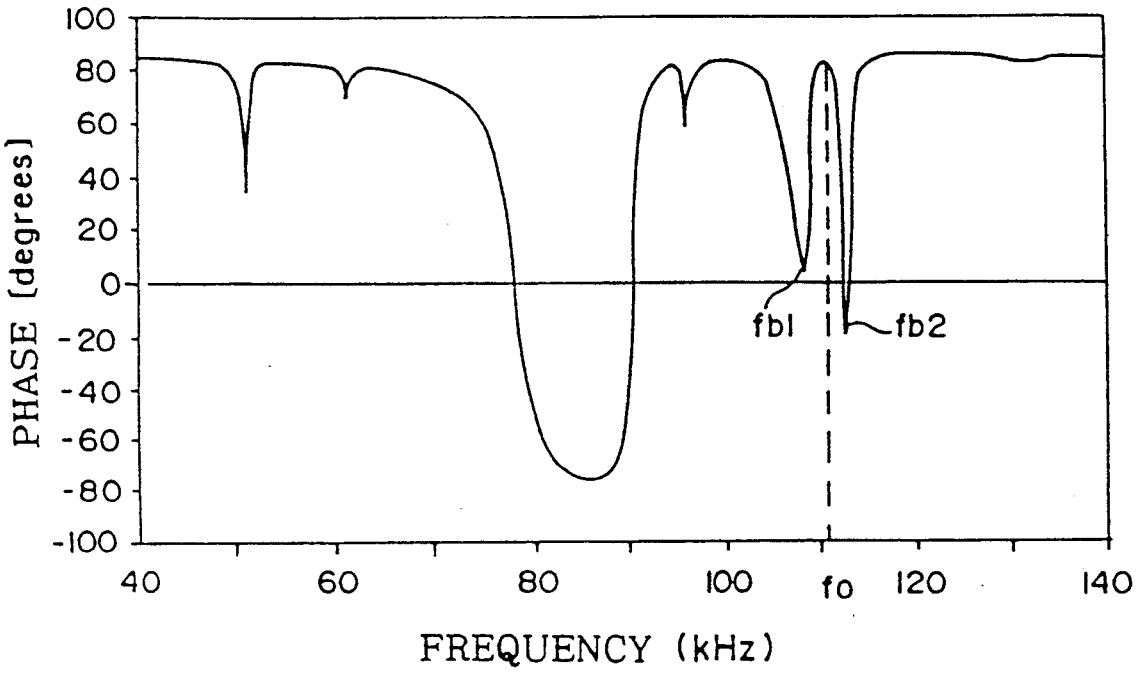
FIG. 16 shows the relationship between the phase of the impedance of the ultrasonic vibrator shown in FIG. 12 and frequency.

FIG. 15 shows the relationship between the phase of the impedance of piezoelectric vibrator 1, shown in FIG. 12, and frequency. FIG. 16 shows the relationship between the phase of the impedance of the device composed of piezoelectric vibrator 1 and vibrating plate 2, shown in FIG. 12, and frequency. With the phase set to zero degrees, the value of the frequency represents the resonance frequency. Therefore, in FIG. 15, piezoelectric vibrator 1 has four resonance frequencies. The designation fa in FIG. 15 shows the intermediate value for two of the resonance frequencies among the four resonance frequencies. In FIG. 16, the peak around fa is separated into two, causing the resonance frequencies fb1 and fb2 to be generated. The intermediate value fo, therefore, shows the frequency when the atomizing quantity becomes maximum, and fo is almost equivalent to the fa. Thus, by employing such a structure having the intermediate value between of the two resonance frequencies of the device, composed of the piezoelectric vibrator and the vibrating plate, becomes almost equivalent to the resonance frequency of the single piezoelectric vibrator, and the coupled-mode vibration of the device composed of the piezoelectric vibrator and the vibrating plate is strengthened. Therefore, the atomizing quantity can be further increased. Furthermore, fb1 and fb2 move toward higher frequencies as the length of vibrating part 20 is shortened. As vibrating part 20 becomes far from fa, the atomizing quantity is decreased.

FIG. 17(A) shows a perspective view of still another embodiment of the ultrasonic vibrator shown in FIG. 5. In FIG. 17(A) the ultrasonic vibrator has piezoelectric vibrator 41 which is 20 mm in length, 5 mm in width and 6 mm in thickness and vibrating plate 46 having vibrating part 47 which is 10.5 mm in length, 5 mm in width and 0.04 mm in thickness and cemented part 48 which is 1.5 mm in length, 5 mm in width and 0.04 mm in thickness. Au electrodes, 43, 44 and 45 are formed on both end surfaces, perpendicular to the polarization axis direction of piezoelectric ceramic 42. Electrodes 43 and 44 are mounted on the same surface and insulated from each other. Electrode 43 covers a length of 15 mm from the distal end of piezoelectric ceramic 42 and is used as the electrode for applying the alternating current voltage to piezoelectric vibrator 41. Electrode 44 covers the remaining portion of piezoelectric ceramic 42 and is separated by 1 mm from electrode 43 and is used as an electrode for a self-exciting power supply, which operates at a frequency equal to the resonance frequency of the device composed of the piezoelectric vibrator and the vibrating plate. When the ultrasonic vibrator of FIG. 17(A) is employed, the atomizing quantity becomes maximum at a frequency of about 100 kHz yielding particles which are minute and uniform. Thus, when a rectangular prism-like structure is provided having a ratio of thickness to width of nearly 1, but not exactly equal to 1, the coupled-mode vibration of the device composed of the piezoelectric vibrator and the vibrating plate is strengthened, and the atomizing quantity is further increased. By employing two electrodes, which are insulated from each other, on one end surface perpendicular to the polarization axis of the piezoelectric ceramic, one of the electrodes can be used as the electrode for a self-exciting power supply. It is therefore possible to provide a stabilized and very efficient ultrasonic vibrating device which is operated with very low power consumption.

Figure 17:
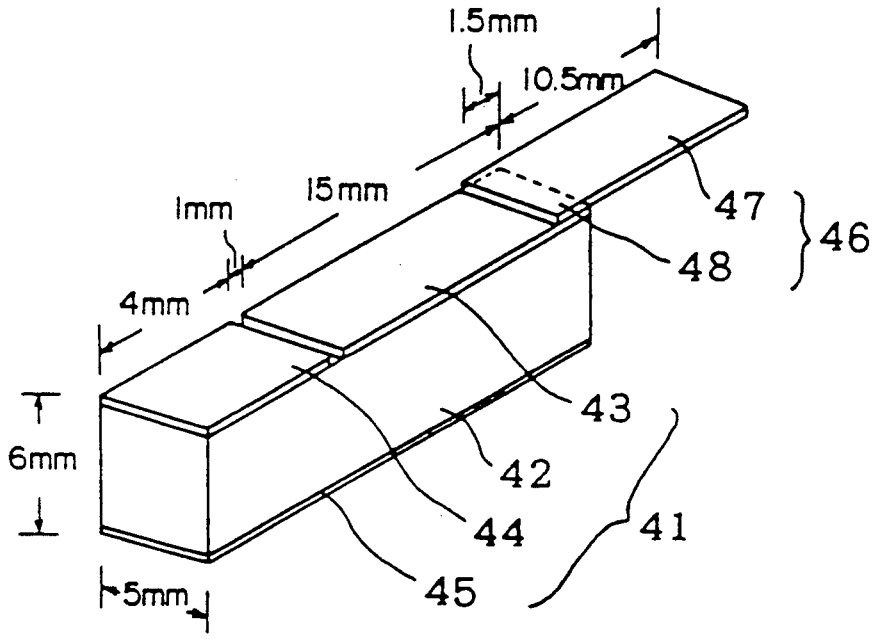
FIG. 17(A) shows a perspective view of another embodiment of the ultrasonic vibrator.
FIG. 17(B) shows a perspective view of another embodiment of the ultrasonic vibrator.
Figure 17:
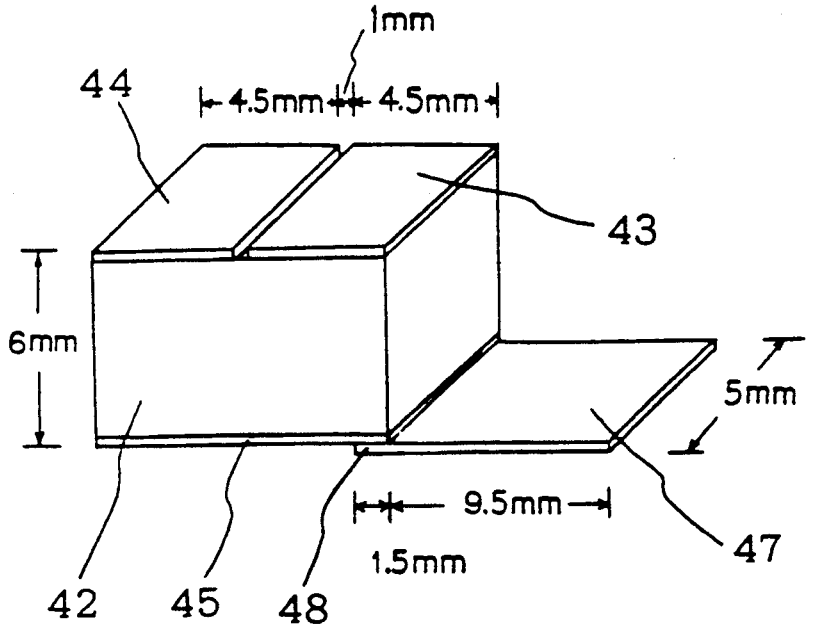

FIG. 17(B) shows a perspective view of another embodiment of ultrasonic vibrator shown in FIG. 17(A). In FIG. 17(B) the ultrasonic vibrator includes piezoelectric vibrator 41 which is 10 mm in length, 5 mm in width and 6 mm in thickness and vibrating plate 46 which is 11 mm in length, 5 mm in width and 0.04 mm in thickness. Vibrating plate 46 is mounted under piezoelectric vibrator 41 unlike the ultrasonic vibrator in FIG. 17(A). The ultrasonic vibrator of FIG. 17(B), very much like the ultrasonic vibrator of FIG. 17(*a*), provides a stabilized and very efficient ultrasonic vibrating device which is operated with very low power consumption.

Figure 18:
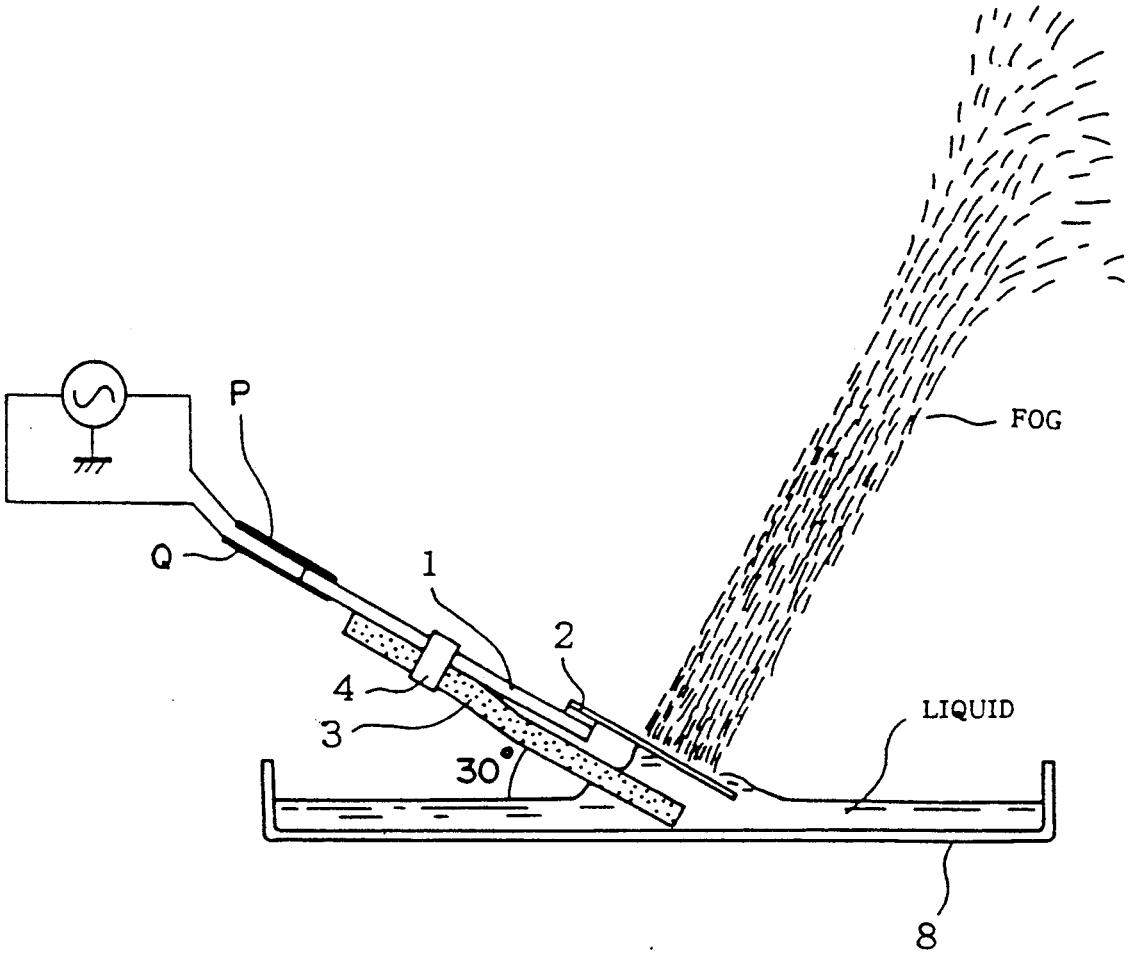
FIG. 18 shows a sectional view of another embodiment of the ultrasonic vibrating device.

FIG. 18 shows a sectional view of another embodiment of the ultrasonic vibrating device, which obviates the need for liquid supplying tube 5, flow control valve 6 and liquid tank 7 of the embodiment shown in FIG. 1. This embodiment includes a liquid bath 8. The liquid bath 8 is supplied with an adequate amount of liquid when the ultrasonic vibrating device is in use. The ultrasonic vibrator composed of piezoelectric vibrator 1 and vibrating plate 2 is jointed to assistance board 3 by clip 4 and only the distal end of the vibrating plate 2 touches the liquid in liquid bath 8. The ultrasonic vibrating device is disposed at an angle of 30 degrees to the liquid surface. The inclined position limits the amount of liquid touching vibrating plate 2 and makes for effective atomizing. Unnecessary contact with the surface liquid must be minimized, because otherwise energy of the ultrasonic vibrating device will be discharged in the liquid causing atomization efficiency to be lowered.

If an alternating current signal having substantially the same frequency as the resonance frequency of the device, composed of piezoelectric vibrator 1 and vibrating plate 2, is applied to piezoelectric vibrator 1 through electrode terminals, P and Q, then when operating the ultrasonic vibrating device shown in FIG. 18, piezoelectric vibrator 1 is vibrated. At this time, the frequency of the alternating current signal is almost matched with one of the resonance frequencies of piezoelectric vibrator 1. Because vibrating plate 2 is cemented and integrally interlocked with at least one end surface of piezoelectric vibrator 1, vibrating plate 2 can vibrate just like a one-side supported overhanging beam with cemented part 21 acting as a cementing end. A liquid which is supplied to the vibrating part 20 under a strong acoustic vibrating condition can be atomized or sprayed upwards in the vertical direction.

In the ultrasonic vibrating device shown in FIG. 18, the liquid which is supplied in liquid bath 8 during vibration from vibrating part 20 is led to respective holes 22 by capillarity. When the liquid passes through each of holes 22, the liquid passing area in each one of the holes 22 is reduced from the inlet side thereof to the outlet side thereof. Therefore, the liquid is squeezed out by respective holes 22, causing the liquid to have minute and uniform particles and to flow out on vibrating part 20. Consequently the liquid which flows out from respective holes 22 can be atomized very effectively by virtue of the above squeezing action, the acoustic vibration of vibrating part 20, and the liquid limiting action provided by assistance board 3.

Figure 19:
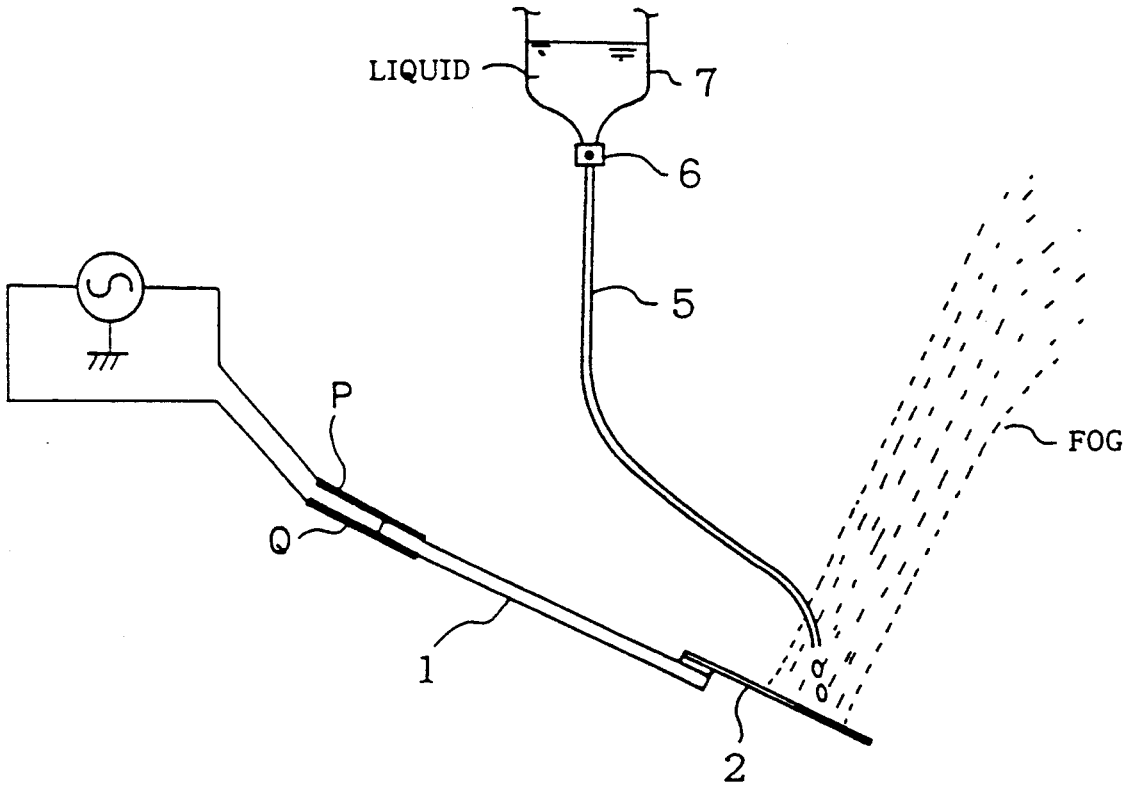
FIG. 19 shows a sectional view of another embodiment of the ultrasonic vibrating device.

FIG. 19 shows a sectional view of another embodiment of the ultrasonic vibrating device, which obviates the need for assistance board 3 and clip 4 of the first embodiment shown in FIG. 1. Liquid supplying tube 5 is set over the vibrating plate 2. In operation, the liquid flow rate from liquid tank 7 is controlled by flow control valve 6 and the liquid passing through liquid supplying tube 5 is made to drop on the surface of vibrating plate 2. As such, the amount of liquid coming in contact with vibrating plate 2 can be controlled, making it possible to supply the amount of liquid at which the atomization efficiency becomes greatest.

If the alternating current signal having substantially the same frequency as the resonance frequency of the device, composed of piezoelectric vibrator 1 and vibrating plate 2, is applied to piezoelectric vibrator 1 through electrode terminals, P and Q, then when operating the ultrasonic vibrating device shown in FIG. 19, piezoelectric vibrator 1 is vibrated. At this time, the frequency of the alternating current signal is almost matched with one of the resonance frequencies of piezoelectric vibrator 1. Because vibrating plate 2 is cemented and integrally interlocked with at least one end surface of piezoelectric vibrator 1, vibrating plate 2 can vibrate just like a one-side supported overhanging beam with cemented part 21 acting as a cementing end. A liquid which is supplied to vibrating part 20 under a strong acoustic vibrating condition can be atomized or sprayed upwards in the vertical direction.

In the ultrasonic vibrating device shown in FIG. 19, liquid dropped on the surface of vibrating plate 2, and passed through liquid supplying tube 5 from liquid tank 7, is efficiently atomized by the acoustic vibration of vibrating part 20, the effects of holes 22, and the amount of liquid provided on the surface of vibrating part 20 is controlled by the dropping structure.

Figure 20:
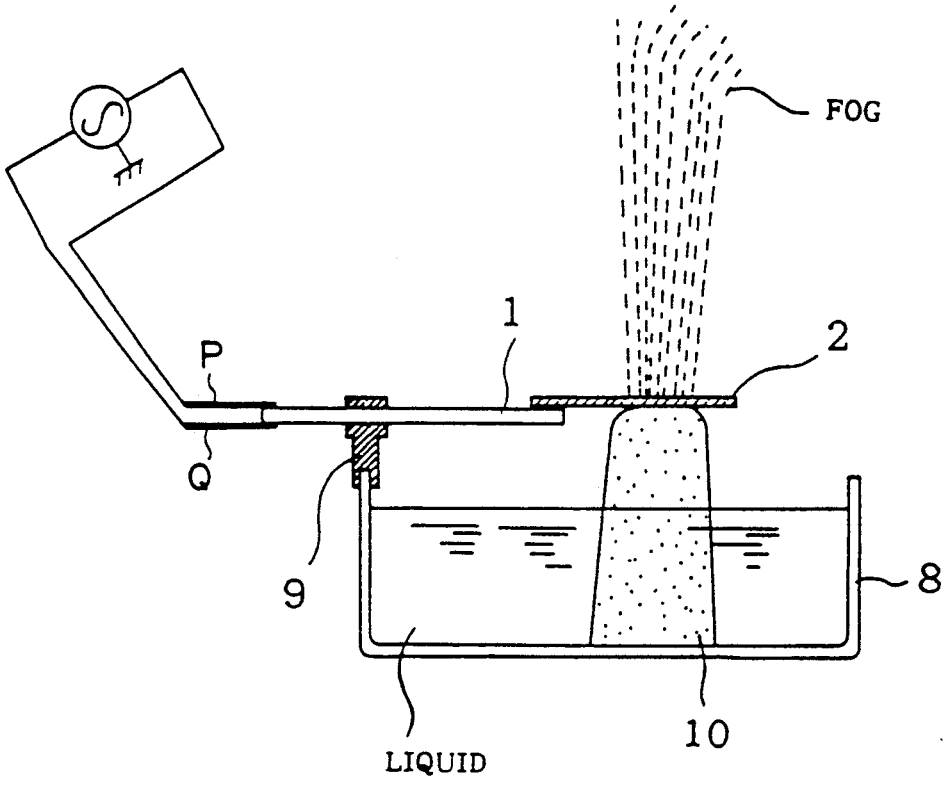
FIG. 20 shows a sectional view of another embodiment of the ultrasonic vibrating device.

FIG. 20 shows a sectional view of another embodiment of the ultrasonic vibrating device. The ultrasonic vibrating device comprises piezoelectric vibrator 1, vibrating plate 2, liquid bath 8, supporter 9 and liquid keeper 10. A power supply circuit is also provided which supplies piezoelectric vibrator 1 with an alternating current voltage. Liquid bath 8 is supplied with an adequate amount of liquid in operation. Electrode terminals, P and Q, are cemented by an adhesive agent having a high conductivity. Supporter 9 is made from foamed styrene and can fix piezoelectric vibrator 1 at liquid bath 8. Foamed styrene provides an acoustic impedance that is very low compared with that of piezoelectric vibrator 1. Vibrations from piezoelectric vibrator are suppressed by supporter 9 thereby preventing dispersion therefrom. Thus, vibrating plate 2 is vibrated very effectively, resulting in increased atomization efficiency. A liquid supplying means is provided which includes liquid bath 8 and liquid keeper 10 for lifting liquid from liquid bath 8 and for supplying it to vibrating part 2. Liquid keeper 10 is made of sponge or other materials having large liquid suction capacity. As a result, not only the liquid supplying efficiency can be enhanced but also constant liquid supplying can be realized. Therefore, stabilized atomizing and an increase of atomization efficiency is realized.

If an alternating current signal having substantially the same frequency as the resonance frequency of the device, composed of piezoelectric vibrator 1 and vibrating plate 2, is applied to piezoelectric vibrator 1 through electrode terminals, P and Q, then when operating the ultrasonic vibrating device shown in FIG. 20, piezoelectric vibrator 1 is vibrated. At this time, the frequency of the alternating current signal is almost matched with one of the resonance frequencies of piezoelectric vibrator 1. Because vibrating plate 2 is cemented and integrally interlocked with at least one end surface of piezoelectric vibrator 1, vibrating plate 2 can vibrate just like a one-side supported overhanging beam with cemented part 21 acting as a cementing end. A liquid which is supplied to vibrating part 20 under a strong acoustic vibrating condition can be atomized or sprayed upwards in the vertical direction.

In the ultrasonic vibrating device shown in FIG. 20, the liquid in liquid bath 8 is lifted up by liquid keeper 10 and reaches the underside of vibrating plate 2. The liquid is led to respective holes 22 by capillarity during the vibration of vibrating part 20. When the liquid passes through each of holes 22, the passing area of the liquid in each of the holes 22 is reduced from the inlet side thereof to the outlet side thereof. Therefore, the liquid is squeezed out by respective holes 22, causing the liquid to have minute and uniform particles and to flow out on vibrating part 20. Consequently, the liquid which flows out from respective holes 22 is atomized very effectively by virtue of the above squeezing action, and the acoustic vibration of vibrating part 20.

Furthermore, in the ultrasonic vibrating devices shown in the embodiment of FIG. 18, the embodiment of FIG. 19, and the embodiment of FIG. 20, such characteristics as shown in FIG. 9, FIG. 10 and FIG. 11 with respect to the embodiment of FIG. 1, have also been observed. Furthermore, when the embodiment of FIG. 18, the embodiment of FIG. 19 and the embodiment of FIG. 20 are provided with the ultrasonic vibrator shown in FIG. 12, FIG. 17(A) and FIG. 17(B), similar operating characteristics to those obtained by the embodiment of FIG. 1 provided with the ultrasonic vibrators in FIG. 12, FIG. 17(A) and 17(B) can be observed as well.

Figure 21:
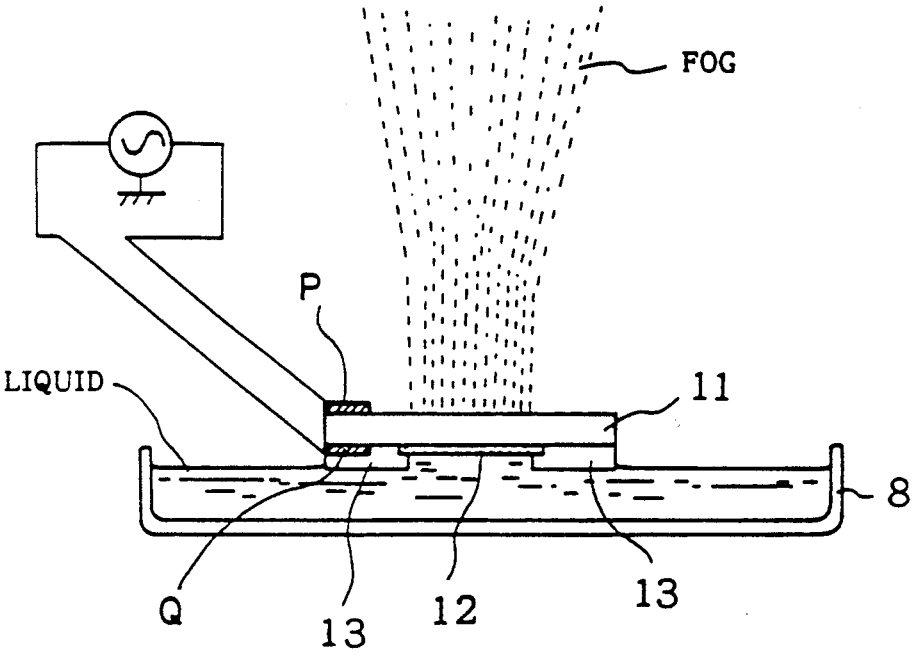
FIG. 21 shows a sectional view of another embodiment of the ultrasonic vibrating device.

FIG. 21 shows a sectional view of another embodiment of the ultrasonic vibrating device according to the present invention. In this embodiment the ultrasonic vibrating device comprises piezoelectric vibrator 11 to which a pair of electrode terminals, P and Q, made from copper ribbon are mounted, vibrating plate 12, assistance board 13 made from foamed styrene and liquid bath 8. There is also provided a power supply circuit which supplies piezoelectric vibrator 11 with an alternating current voltage. Liquid bath 8 is supplied with an adequate amount of liquid in operation. Electrode terminals, P and Q, are cemented by an adhesive agent having a high conductivity.

The ultrasonic vibrator composed of piezoelectric vibrator 11 and vibrating plate 12 is jointed to assistance board 13, and floats on the liquid in use. At this time, assistance board 13 insulates piezoelectric vibrator 11 from the liquid and prevents ultrasonic vibration energy from being discharged into the liquid. Therefore, the energy can be effectively transmitted to vibrating plate 12. Foamed styrene material has an acoustic impedance which is very low compared with that of the piezoelectric vibrator material. The transmittance of vibrations from piezoelectric vibrator 11 to assistance board 13 is suppressed and piezoelectric vibrator is vibrated efficiently, so that the atomization efficiency is increased. By floating the ultrasonic vibrating device on the liquid, an adequate amount of liquid is supplied to vibrating plate 12 at all times, without being influenced by the increase or decrease of liquid in liquid bath 8. Thus, efficient atomizing can be realized. A great deal of atomizing is realized with minimum power consumption. In addition, it is easily possible to make the device small and compact. Furthermore, efficient atomizing is realized by supplying an adequate amount of liquid to vibrating plate 12 with the ultrasonic vibrator held at a predetermined position by means of fixing assistance board 13.

Figure 22:
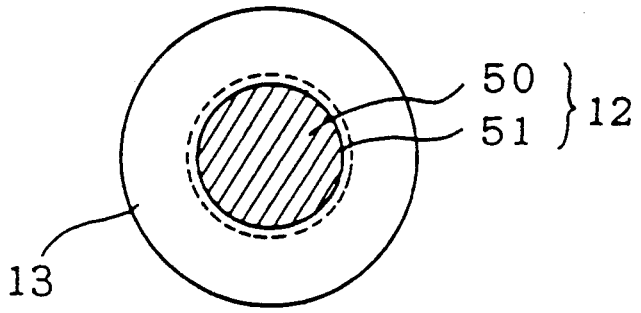
FIG. 22 shows a bottom plan view of the ultrasonic vibrator set on the supporter 13 of the embodiment shown in FIG. 21.
Figure 23:
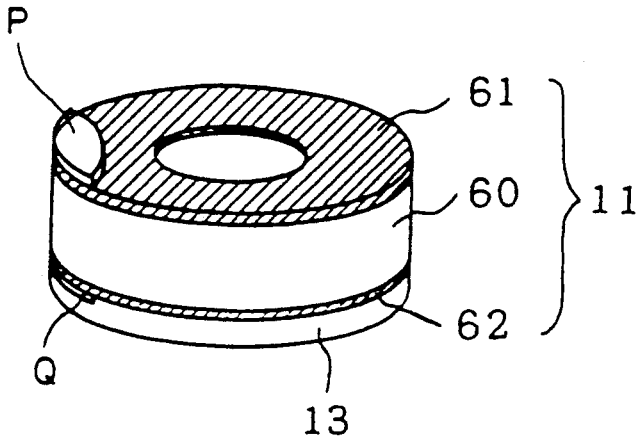
FIG. 23 shows a perspective view of the ultrasonic vibrating device of the embodiment shown in FIG. 21.

FIG. 22 shows a bottom plan view of the ultrasonic vibrator set on the assistance board 13. FIG. 23 shows a perspective view of the ultrasonic vibrating device of the embodiment shown in FIG. 21. Piezoelectric vibrator 11 has a column-like piezoelectric ceramic 60 having a hole therein parallel to the polarization axis, and having two end surface perpendicular to the polarization axis. Piezoelectric ceramic 60 is made of TDK-72A material (manufactured by TDK, Ltd. of Japan), and is 24 mm diameter and 6 mm thick. The hole is also column-like and is 12 mm in thickness. TDK-72A material has been used in the embodiment because of its large electromechanical coupling constant. Au electrode 61 and Au electrode 62 are formed on the two end surfaces, respectively. Au electrode 61 is provided with electrode terminal P, and Au electrode 62 is provided with electrode terminal Q.

A disk-like vibrating plate 12 is mounted at a position which covers the opening of the hole at the underside end surface of piezoelectric vibrator 11 (see FIG. 21). Vibrating plate 12 is made of nickel and is fixed to be integrally interlocked with piezoelectric vibrator 11 by a ring-like cemented part 51 (see FIG. 22). Vibrating plate 12 surrounded by cemented part 51 forms vibrating part 50. Cemented part 51 is cemented to piezoelectric vibrator 11 with an adhesive agent with high conductivity and in contact with Au electrode 62. The diameter of vibrating plate 12 is 14 mm and the thickness thereof is 0.05 mm. The diameter of vibrating part 50 is matched with that of the hole and is 12 mm, the thickness being 0.05 mm. Vibrating part 50 is provided with a plurality of minute holes which penetrate in the thickness direction, and the dimension and shape thereof are the same as those of holes 22 shown in FIG. 6 and FIG. 8. Thus, by employing the ring-like structure as the piezoelectric ceramic, in which the hole is penetrated through parallel to the polarization axis thereof, and by mounting the vibrating plate almost parallel to the end faces, on a position which covers the opening of the hole at the underside end surface of piezoelectric vibrator 11, vibrating plate 12 is vibrated efficiently and the atomization efficiency is thereby increased.

If an alternating current signal having substantially the same frequency as the resonance frequency of the device, composed of piezoelectric vibrator 11 and vibrating plate 12, is applied to piezoelectric vibrator 11 through electrode terminals, P and Q, then when operating the ultrasonic vibrating device shown in FIG. 21, piezoelectric vibrator 11 is vibrated. At this time, vibrating part 50 which is surrounded by the ring-like cemented part 51 creates coupled-mode vibrations integrally together with piezoelectric vibrator 11. Thus, by mounting vibrating plate 12 on the position which covers the opening of the hole of piezoelectric vibrator 11 linking these components together as one body, there is provided a structure wherein when one of the resonance frequencies of the device is almost matched with one of the resonance frequencies of piezoelectric vibrator 11, vibrating part 50 creates coupled-mode vibrations since vibrating part 50 is integrally coupled together with piezoelectric vibrator 11. The coupled-mode vibration of vibrating part 50 acts very effectively for atomizing the liquid. The liquid which is supplied in liquid bath 8 during vibration of vibrating part 50 is led to respective holes 22 by capillarity. When the liquid passes through each one of holes 22, the passing area of the liquid is reduced from the inlet side thereof to the outlet side thereof. Therefore, the liquid is squeezed out by respective holes 22, causing the liquid to have minute and uniform particles and to flow out on vibrating part 50. Consequently, the liquid which flows out from respective holes 22 can be atomized very effectively by virtue of the above squeezing action, the coupled-mode vibration of vibrating part 50, and the effect that is provided by assistance board 13 which insulates piezoelectric vibrator 11 from coming in contact with the liquid.

Figure 24:
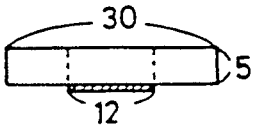
FIG. 24 is a table showing applied voltage, frequency, input power and current for three different types of ultrasonic vibrators of the type shown in FIG. 21.
Figure 24:
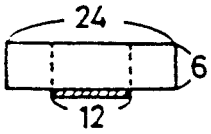
Figure 24:
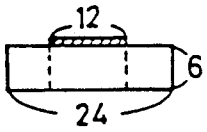

FIG. 24 shows the characteristics of three types of ultrasonic vibrators which can be used in the embodiment shown in FIG. 21. In devices of type I and II, vibrating plate 12 is mounted on the underside of piezoelectric vibrator 11. A type III device includes piezoelectric vibrator 11 and vibrating plate 12 having dimensions similar to those of a in a type II device, however vibrating plate 12 is mounted on the upperside of piezoelectric vibrator 11. A type II device is shown in FIG. 21. In a type II device, atomizing quantity is maximum at a frequency of 286.1 kHz when the applied voltage is 7.0 V. At such time, the input power is 140 mW and the current loading is 20 mA, and the input power and current loading for the ultrasonic vibrating device as a whole is 280 mW and 40 mA, respectively.

If a ring-like structure is provided having a ratio of a length in the direction of the polarization axis of the piezoelectric vibrator to the shortest distance of the outer edge and the inner edge of the end surface, of approximately equal to 1, the coupled-mode vibration of a device composed of piezoelectric vibrator 11 and vibrating plate 12 can be strengthened, and the atomizing quantity further increased.

If a second vibrating plate is added to an vibrating device such as a Type II device which has the vibrating plate mounted on the upperside of the piezoelectric vibrator, it was observed that the atomizing quantity is decreased while the properties characteristic of a type II device remained unchanged. However, by providing a plurality of vibrating plates remarkably minute fog particles were effectively generated. Thus, if a plurality of vibrating plates are provided, fog particle minuteness is selectively controllable.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. An ultrasonic device comprising:

piezoelectric vibrator means including a piezoelectric vibrator and a vibrating plate mounted on said piezoelectric vibrator, said piezoelectric vibrator means for atomizing a liquid by the acoustic vibration generated by said vibrating plate in response to actuation by said piezoelectric vibrator, said piezoelectric vibrator and said vibrating plate cooperatively forming a vibrating assembly;

means for supplying the liquid to said vibrating plate of said piezoelectric vibrator means, said vibrating plate having a plurality of holes so that the liquid penetrates said plurality of holes during atomizing of the liquid; and a pair of electrodes oppositely disposed along two surfaces of said piezoelectric vibrator, said two surfaces running perpendicular to the direction of thickness of said piezoelectric vibrator, said pair of electrodes receiving a signal and causing said piezoelectric vibrator to vibrate;

wherein said means for supplying said vibrating plate with said liquid comprises a supporting board positioned parallel to said vibrating plate and at a fixed distance from said vibrating plate; and means for maintaining said ultrasonic device at a fixed, inclined angle relative to the surface of the liquid, said liquid being accommodated by a liquid bath, and by positioning the vibrating plate over the top surface of said supporting board, said supporting board being made from a material having an acoustic impedance which is low compared with the acoustic impedance of the piezoelectric vibrator.

2. A device as defined in claim 1, wherein at least one of said pair of electrodes connects said piezoelectric vibrator to said vibrating plate, said vibrating plate mounted such that at least a first surface portion of said vibrating plate is coupled to said piezoelectric vibrator and at least a second portion, which includes at least some of said plurality of holes, prominently extends outwardly from said piezoelectric vibrator.

3. A device as defined in claim 1, wherein the resonance frequency of said piezoelectric vibrator is approximately equal to a median value of two resonance frequencies of the vibrating assembly.

4. A device as defined in claim 1, wherein said piezoelectric vibrator is in a rectangular form and the ratio of length or thickness to width of said rectangular form is substantially equal to 1.

5. A device as defined in claim 1, wherein one of said pair of electrodes includes at least a first portion and a second portion such that said first and second portions are not connected to each other.

6. A device as defined in claim 1, wherein said piezoelectric ceramic includes a pierced hole located parallel to a polarization axis of said piezoelectric ceramic, said vibrating plate covering an opening of said pierced hole and positioned perpendicular to said polarization axis is mounted such that at least a portion of said pierced hole inside of the piezoelectric ceramic is coupled to a flange of said vibrating plate attached thereto.

7. A device as defined in claim 1, wherein the piezoelectric vibrator is capable of resonating at any one of a plurality of frequencies, one of said frequencies being approximately equal to one of the resonance frequencies of the assembly.

8. A device as defined in claim 1, wherein said piezoelectric vibrator is one of at least a rectangle and a circle, and the ratio between the length in the direction of the polarization axis of said piezoelectric vibrator and the shortest distance of the outer edge and the inner edge of an end surface is approximately equal to 1.

9. A device as defined in claim 1, wherein said means for supplying said vibrating plate with said liquid comprises a liquid tank and a tube for supplying said vibrating plate with said liquid from said liquid tank.

10. A device as defined in claim 1, wherein said means for supplying said vibrating plate with said liquid comprises a liquid tank and means for drawing and guiding said liquid from said liquid tank and dropping said liquid on said vibrating plate.

11. A device as defined in claim 1, wherein said means for supplying said vibrating plate with said liquid comprises a sponge-like liquid-storage material having a large absorption ability for dispensing liquid to said vibrating plate, and a liquid bath for accommodating said sponge-like liquid-storage material.

12. An ultrasonic device comprising:

piezoelectric vibrator means including a piezoelectric vibrator and a vibrating plate mounted on said piezoelectric vibrator, said piezoelectric vibrator means for atomizing a liquid by the acoustic vibration generated by said vibrating plate in response to actuation by said piezoelectric vibrator, said piezoelectric vibrator and said vibrating plate cooperatively forming a vibrating assembly;

means for supplying the liquid to said vibrating plate of said piezoelectric vibrator means, said vibrating plate having a plurality of holes so that the liquid penetrates said plurality of holes during atomizing of the liquid, the circumference of an inlet opening portion of each of the plurality of holes disposed on said vibrating plate being different from the circumference of each respective outlet opening portion corresponding thereto; and a pair of electrodes oppositely disposed along two surfaces of said piezoelectric vibrator, said two surfaces running perpendicular to the direction of thickness of piezoelectric vibrator, said pair of electrodes receiving a signal and causing said piezoelectric vibrator to vibrate.

13. A device as defined in claim 12, wherein at least one of said pair of electrodes connects said piezoelectric vibrator to said vibrating plate, said vibrating plate mounted such that at least a first surface portion of said vibrating plate is coupled to said piezoelectric vibrator and at least a second portion, which includes at least some of said plurality of holes, prominently extends outwardly from said piezoelectric vibrator.

14. A device as defined in claim 12, wherein the resonance frequency of said piezoelectric vibrator is approximately equal to a median value of two resonance frequencies of the vibrating assembly.

15. A device as defined in claim 12, wherein said piezoelectric vibrator is in a rectangular form and the ratio of length of thickness to width of said rectangular form is substantially equal to 1.

16. A device as defined in claim 12, wherein one of said pair of electrodes includes at least a first portion and a second portion such that said first and second portions are not connected to each other.

17. A device as defined in claim 12, wherein said piezoelectric ceramic includes a pierced hole located parallel to a polarization axis of said piezoelectric ceramic, said vibrating plate covering an opening of said pierced hole and positioned perpendicular to said polarization axis is mounted such that at least a portion of said pierced hole inside of the piezoelectric ceramic is coupled to a flange of said vibrating plate attached thereto.

18. A device as defined in claim 12, wherein the piezoelectric vibrator is capable of resonating at any one of a plurality of frequencies, one of said frequencies being approximately equal to one of the resonance frequencies of the vibrating assembly.

19. A device as defined in claim 12, wherein said piezoelectric vibrator is one of at least a rectangle and a circle, and the ratio between the length in the direction of the polarization axis of said piezoelectric vibrator and the shortest distance of the outer edge and the inner edge of an end surface is approximately equal to 1.

20. A device as defined in claim 12, wherein said means for supplying said vibrating plate with said liquid comprises:

a supporting board positioned parallel to said vibrating plate and at a fixed distance from said vibrating plate; and means for maintaining said ultrasonic device at a fixed, inclined angle relative to the surface of the liquid, wherein said liquid is accommodated by a liquid bath, and by positioning the vibrating plate over the top surface of said supporting board, said supporting board being made from a material having an acoustic impedance which is low compared with the acoustic impedance of the piezoelectric vibrator.

21. A device as defined in claim 13, wherein said means for supplying said vibrating plate with said liquid comprises:

a supporting board positioned parallel to said vibrating plate and at a fixed distance from said vibrating plate; and means for maintaining said ultrasonic device at a fixed, inclined angle relative to the surface of the liquid, wherein said liquid is accommodated by a liquid bath, and by positioning the vibrating plate over the top surface of said supporting board, said supporting board being made from a material having an acoustic impedance which is low compared with the acoustic impedance of the piezoelectric vibrator.

22. A device as defined in claim 16, wherein said means for supplying said vibrating plate with said liquid comprises:

a supporting board positioned parallel to said vibrating plate and at a fixed distance from said vibrating plate; and means for maintaining the ultrasonic device at a fixed, inclined angle relative to the surface of the liquid, wherein said liquid is accommodated by a liquid bath, and by positioning the vibrating plate over the top surface of said supporting board, said supporting board being made from a material having an acoustic impedance which is low compared with the acoustic impedance of the piezoelectric vibrator.

23. A device as defined in claim 12, wherein said means for supplying said vibrating plate with said liquid comprises:

a supporting board for supporting said piezoelectric vibrator; and a liquid bath for accommodating a liquid, said supporting board for maintaining the ultrasonic device in one of a fixed state and a buoyancy state, said buoyancy state causing said ultrasonic device to float in said liquid, said supporting board being made from a material having an acoustic impedance which is low compared with the acoustic impedance of said piezoelectric vibrator.

24. A device as defined in claim 17, wherein said means for supplying said vibrating plate with said liquid comprises:

a supporting board for supporting said piezoelectric vibrator; and a liquid bath for accommodating a liquid, said supporting board for maintaining the ultrasonic device in one of a fixed state and a buoyancy state, said buoyancy state causing said ultrasonic device to float in said liquid, said supporting board being made form a material having an acoustic impedance which is low compared with the acoustic impedance of said piezoelectric vibrator.

25. A device as defined in claim 18, wherein said means for supplying said vibrating plate with said liquid comprises:

a supporting board for supporting said piezoelectric vibrator; and a liquid bath for accommodating a liquid, said supporting board for maintaining the ultrasonic device in one of a fixed state and a buoyancy state, said buoyancy state causing said ultrasonic device to float in said liquid, said supporting board being made from a material having an acoustic impedance which is low compared with the acoustic impedance of said piezoelectric vibrator.

26. A device as defined in claim 19, wherein said means for supplying said vibrating plate with said liquid comprises:

a supporting board for supporting said piezoelectric vibrator; and a liquid bath for accommodating a liquid, said supporting board for maintaining the ultrasonic device in one of a fixed state and a buoyancy state, said buoyancy state causing said ultrasonic device to float in said liquid, said supporting board being made from a material having an acoustic impedance which is low compared with the acoustic impedance of said piezoelectric vibrator.

27. A device as defined in claim 12, wherein said means for supplying said vibrating plate with said liquid comprises a liquid tank and a tube for supplying said vibrating plate with said liquid from said liquid tank.

28. A device as defined in claim 12, wherein said means for supplying said vibrating plate with said liquid comprises a liquid tank and means for drawing and guiding said liquid from said liquid tank and dropping said liquid on said vibrating plate.

29. A device as defined in claim 12, wherein said means for supplying said vibrating plate with said liquid comprises a sponge-like liquid-storage material having a large absorption ability for dispensing liquid to said vibrating plate, and a liquid bath for accommodating said sponge-like liquid-storage material.

30. An ultrasonic device comprising:

piezoelectric vibrator means including a piezoelectric vibrator and a vibrating plate mounted on said piezoelectric vibrator, said piezoelectric vibrator means for atomizing a liquid by the acoustic vibration generated by said vibrating plate in response to actuation by said piezoelectric vibrator, said piezoelectric vibrator and said vibrating plate cooperatively forming a vibrating assembly;

means for supplying the liquid to said vibrating plate of said piezoelectric vibrator means, said vibrating plate having a plurality of holes so that the liquid penetrates said plurality of holes during atomizing of the liquid; and a pair of electrodes oppositely disposed along two surfaces of said piezoelectric vibrator, said two surfaces running perpendicular to the direction of thickness of said piezoelectric vibrator, said pair of electrodes receiving a signal and causing said piezoelectric vibrator to vibrate;

wherein said means for supplying said vibrating plate with said liquid comprises a liquid tank and means for drawing and guiding said liquid from said liquid tank and dropping said liquid on said vibrating plate.

31. A device as defined in claim 30, wherein the circumference of an inlet opening portion of each of the plurality of holes disposed on said vibrating plate is different from the circumference of each respective outlet opening portion corresponding thereto.

32. A device as defined in claim 30, wherein at least one of said pair of electrodes connects and piezoelectric vibrator to said vibrating plate, said vibrating plate mounted such that at least a first surface portion of said vibrating plate is coupled to said piezoelectric vibrator and at least a second portion, which includes at least some of said plurality of holes, prominently extends outwardly from said piezoelectric vibrator.

33. A device as defined in claim 30, wherein the resonance frequency of said piezoelectric vibrator is approximately equal to a median value of two resonance frequencies of the vibrating assembly.

34. A device as defined in claim 30, wherein said piezoelectric vibrator is in a rectangular form and the ratio of length or thickness to width of said rectangular form is substantially equal to 1.

35. A device as defined in claim 30, wherein one of said pair of electrodes includes at least a first portion and a second portion such that said first and second portions are not connected to each other.

36. A device as defined in claim 30, wherein said piezoelectric ceramic includes a pierced hole located parallel to a polarization axis of said piezoelectric ceramic, said vibrating plate covering an opening of said pierced hole and positioned perpendicular to said polarization axis is mounted such that at least a portion of said pierced hole inside of the piezoelectric ceramic is coupled to a flange of said vibrating plate attached thereto.

37. A device as defined in claim 30, wherein the piezoelectric vibrator is capable of resonating at any one of a plurality of frequencies, one of said frequencies being approximately equal to one of the resonance frequencies of the vibrating assembly.

38. A device as define din claim 30, wherein said piezoelectric vibrator is one of at least a rectangle and a circle, and the ratio between the length in the direction of the polarization axis of said piezoelectric vibrator and the shortest distance of the outer edge and the inner edge of an end surface is approximately equal to 1.

39. A device as defined in claim 30, wherein said means for supplying said vibrating plate with said liquid comprises:

a supporting board positioned parallel to said vibrating plate and at a fixed distance from said vibrating plate; and means for maintaining said ultrasonic device at a fixed, inclined angle relative to the surface of the liquid, wherein said liquid is accommodated by a liquid bath, and by positioning the vibrating plate over the top surface of said supporting board, said supporting board being made from a material having an acoustic impedance which is low compared with the acoustic impedance of the piezoelectric vibrator.

40. A device as defined in claim 32, wherein said means for supplying said vibrating plate with said liquid comprises:

a supporting board positioned parallel to said vibrating plate and at a fixed distance from said vibrating plate; and means for maintaining said ultrasonic device at a fixed, inclined angle relative to the surface of the liquid, wherein said liquid is accommodated by a liquid bath, and by positioning the vibrating plate over the top surface of said supporting board, said supporting board being made from a material having an acoustic impedance which is low compared with the acoustic impedance of the piezoelectric vibrator.

41. A device as defined in claim 35, wherein said means for supplying said vibrating plate with said liquid comprises:

a supporting board positioned parallel to said vibrating plate and at a fixed distance from said vibrating plate; and means for maintaining the ultrasonic device at a fixed, inclined angle relative to the surface of the liquid, wherein said liquid is accommodated by a liquid bath, and by positioning the vibrating plate over the top surface of said supporting board, said supporting board being made from a material having an acoustic impedance which is low compared with the acoustic impedance of the piezoelectric vibrator.

42. A device as defined in claim 30, wherein said means for supplying said vibrating plate with said liquid comprises a liquid tank and a tube for supplying said vibrating plate with said liquid from said liquid tank.

43. A device as defined in claim 30, wherein said means for supplying said vibrating plate with said liquid comprises a sponge-like liquid-storage material having a large absorption ability for dispensing liquid to said vibrating plate, and a liquid bath for accommodating said sponge-like liquid-storage material.

* * * * *